US006976940B2

(12) United States Patent
Schneider

(10) Patent No.: US 6,976,940 B2
(45) Date of Patent: Dec. 20, 2005

(54) COMPLETE BODY FITNESS MACHINE

(76) Inventor: Kenneth George Schneider, 1927 18th St., Santa Monica, CA (US) 90404

( * ) Notice: Subject to any disclaimer, the term of this patent is extended or adjusted under 35 U.S.C. 154(b) by 426 days.

(21) Appl. No.: 10/153,943

(22) Filed: May 23, 2002

(65) Prior Publication Data

US 2002/0177510 A1 Nov. 28, 2002

Related U.S. Application Data

(60) Provisional application No. 60/293,359, filed on May 24, 2001.

(51) Int. Cl.[7] ..... A63B 22/00
(52) U.S. Cl. ..... 482/91
(58) Field of Search ..... 482/1–9, 137, 482/92, 111–116, 121–126, 133, 91, 62, 97, 482/139

(56) References Cited

U.S. PATENT DOCUMENTS 3,998,454 A * 12/1976 Jones ..... 482/139
4,778,175 A * 10/1988 Wucherpfennig et al. ..... 482/5
5,074,551 A * 12/1991 Olschansky et al. ..... 482/137
5,088,726 A * 2/1992 Lapcevie ..... 482/97
5,527,251 A * 6/1996 Davis ..... 482/112
5,580,340 A 12/1996 Yu
5,653,669 A 8/1997 Cheng
5,902,215 A 5/1999 Kuo
6,302,833 B1 10/2001 Ellis et al.
6,361,476 B1 3/2002 Eschenbach
6,547,702 B1 * 4/2003 Heidecke ..... 482/62

* cited by examiner

*Primary Examiner*—Glenn E. Richman

(57) ABSTRACT

A "Complete Body Fitness Machine" that provides for a muscle building workout as well as a cardiovascular workout for the total body consists generally of an adjustable seat and two arms on either side, which are adjustable in height and have an infinitely and independently variable resistance possible in either clockwise or counterclockwise rotation. The arms are designed to have several types of mechanisms attached, so as to be able to work with a variety of body parts including, but not limited to, hands, arms, legs, feet, torso, neck and shoulders. When the proper attachment is used, the resistance for each direction of rotation of the arm is set, and the exercise is conducted. Depending on the workout desired, the seat and arms could be adjusted to different positions as well as the seat can be free-moving. This, combined with the fact that the arms can rotate 360-degrees, allows the user to simulate rotational cardiovascular exercises such as cycling, rowing, rotation of the arms in a circular motion (similarly to how the legs rotate in the cycling motion), and even running. The two independent arms are infinitely and separately adjusted for resistance in either rotational direction. This means that the body's natural design of using opposing muscle groups such as the bicep and triceps to bend and straighten the arm can be not only be utilized, but also maximized for efficiency of operation and workout.

6 Claims, 1 Drawing Sheet

COMPLETE BODY FITNESS MACHINE

CROSS-REFERENCE TO RELATED APPLICATIONS

Figure 1:
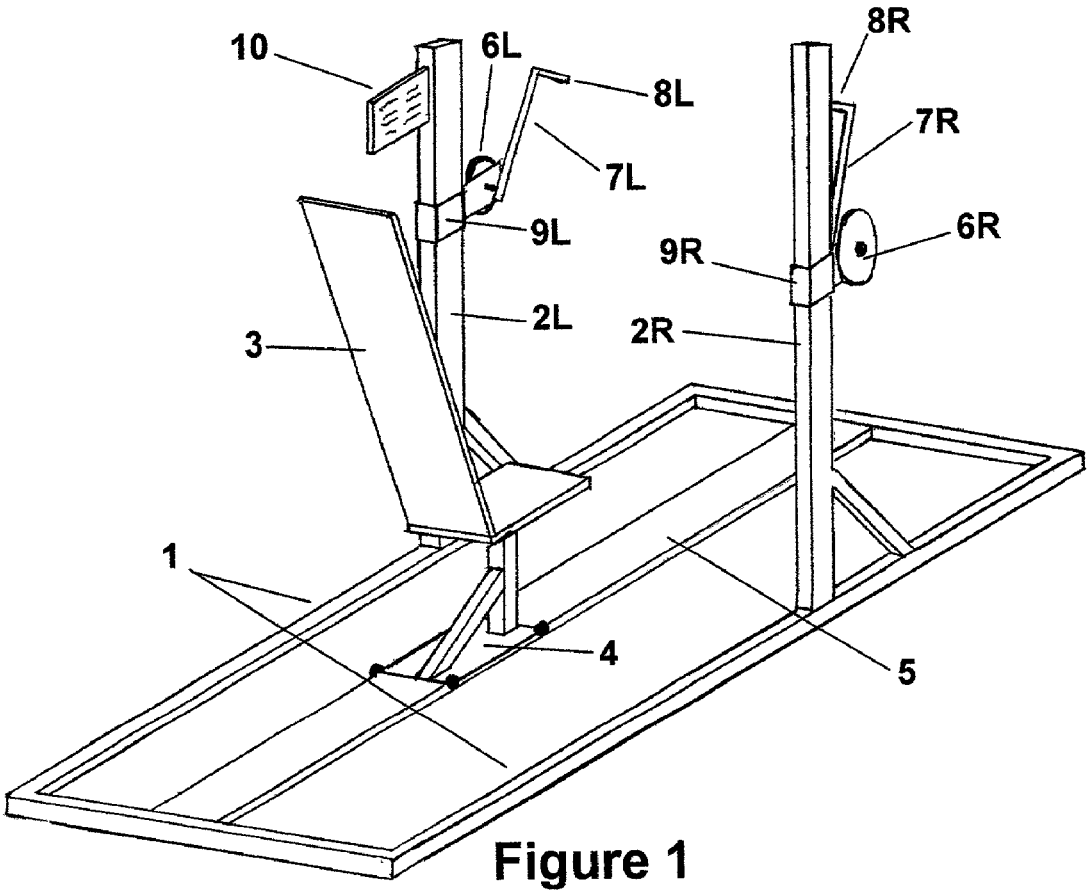

This application claims the benefit of Provisional Patent Application Ser. No. 60/293,359, filed May 24, 2001.

BACKGROUND

1. Field of this Invention

This invention relates broadly to an exercise apparatus and, more particularly, pertains to an exercise apparatus which is capable of performing a variety of efficient muscles building and toning exercises, and cardiovascular exercises in a single machine.

2. Discussion of Prior Art

Although there are a variety of multiple muscle exercise machines, they do not effectively combine a variety of muscle building exercises for the whole body with a variety of cardiovascular exercises for the major muscle groups of the body. Thus, until now, it hasn't been possible to find, within one machine, a true complete body workout for muscle building, toning, and cardiovascular training. Ellis et al. in U.S. Pat. No. 6,302,833 and Cheng in U.S. Pat. No. 5,653,669 describe machines built to provide for a variety of muscle building exercises. However, the setup does not provide for efficient exercise. The resistance/force provided is in one direction at a time. Thus, if a person wanted to exercise the muscles that push, and the muscles that pull back (as the arms will naturally need to do in order to return to their original position to repeat the pushing motion), which is the way all muscle groups in the human body work, it would require the changing the setup of the machine or the position of the person performing the exercise. The muscles that would "pull back" are actually in a state of constant relaxation. Even when returning to the original position on these machines, it would still be the muscles that "push" which are being used to resist the machine's force directed toward the return to the original position. Thus, one would be required to reverse their position, or change the setup, to work those muscles which "pull". This is a very inefficient use of workout time. Furthermore, the resistance is attached to a linear mechanism moving a weight up and allowing gravity to pull it down, so that it is impossible to workout in a complete rotational motion—thus achieving a cardiovascular workout similar to a bicycle motion. The machines are simply not designed to offer any type of true cardiovascular workout. In U.S. Pat. No. 5,580,340 the Multi-functional Exerciser is designed to provide a multi-muscle workout as well. But, once again, the limitations of a single direction resistance/force and the limit of a linear resistance mechanism result in a machine that doesn't offer both, a complete muscular and cardiovascular workout. U.S. Pat. Nos. 6,361,476 and 5,902,215 are both examples of cardiovascular exercise machines which apply rotational resistance technology, but are limited to one exercise, and provide no design for targeted muscle building exercise.

A simple trip to the local gym, someone's home gym, or a late night infomercial viewing, will demonstrate that there exists a large variety of exercise equipment that is geared toward exercising people in a cardiovascular way—working the legs and upper body in a rotational fashion, as well as a large variety of machines targeted at working on muscle building—either targeting individual muscles with a single machine, or multiple muscles with a universal machine similar to the previously mentioned U.S. Pat. No. 5,653,669 by Cheng. It is evident that, until the production of the present invention, there doesn't exist a machine that will, as efficiently as possible, allow for the targeting of all major specific muscle groups for exercise, as well as address the need for an extended cardiovascular exercise within one machine. The present invention, with its design offers the capability to work both the "pushing" and "pulling" muscles of opposing muscle group sets such as bicep and triceps during the same exercise. This reduces the potential workout time in half, as well as offering the cardiovascular workout advantages. These are two critical components recommended by fitness experts, but, until the present invention, not offered in one simple machine.

BACKGROUND OF INVENTION

Fitness machines are generally designed to work on building muscle mass through the repetition of movements by providing a greater resistance against movement in a particular direction, or build muscle tone by providing medium resistance against movement, or work on building cardiovascular strength through a lower resistance and higher repetition of movement. Most muscle building machines are designed to work a specific muscle such as the bicep, pectoral muscle, hamstring, or calf muscle. Some machines are designed to work a variety of muscle groups, but require the operator to change position and motion frequently to change the muscle group targeted for exercise. This reduces the efficiency and convenience of obtaining a total body workout for building muscles. It is well known that a person is more likely to continue a workout routine if it is convenient and enjoyable. Generally, machines that provide for specific muscle building programs do not provide a means of getting a cardiovascular workout—thus creating a need for multiple machines to achieve both a muscular building and cardiovascular workout. An example of this would be a muscle-building machine such as a bench press or leg press machine that is designed to build pectoral or thigh muscles, but doesn't provide the sustained cardiovascular workout of a stationary bicycle. Until now, there hasn't been a single machine that effectively provides for muscle building of all major muscle groups and a variety of cardiovascular workouts. The "Total Body Fitness Machine" is exactly that!

SUMMARY OF INVENTION

Although many machines offer an infinitely variable resistance, they are one dimensional, and do not take advantage of the way the body was designed to work—by utilizing opposing muscle groups. The best way to understand this is through example:

Exercising the major muscles in the arm, the bicep and triceps, are a simple example. The way the arm works is that the bicep flexes to bend the arm while the triceps relax, and conversely, the triceps flex while the bicep relaxes to straighten the arm. Machines that exist today work the bicep by applying resistance against the bending of the arm and the triceps relax throughout the workout. Then, in order to work the triceps, one must change machines, mechanisms, or at least positions. The unique design of the "Total Body Fitness Machine" provides an independent, infinitely variable resistance to either clockwise or counter-clockwise rotation. Thus, the resistance to the bending and straightening of the arm is set separately but simultaneously—providing independent and infinitely variable resistance against movement in both directions. This makes for a very efficient and more effective workout targeting muscle group pairs—as the body was designed to function, and cutting the time necessary to work the same number of muscles as other machines in half. It allows a person to individually adjust the resistance in both directions, thus creating proper resistance as the arm is bent—working the bicep, and creating the possibility of setting a different resistance to movement in the other direction—working the triceps. This means that both muscle groups are worked during the single exercise, where on a traditional system, two separate mechanisms are required to achieve the same goal. Since the resistance in either direction operates independently, one can take into account that opposing muscle groups often have different strengths. As an example, one could set the resistance for the bicep motion to fifty pounds and the triceps' resistance to forty pounds, thus maintaining a proper proportional workout. Another advantage of working in this way is that one will have resistance through the complete range of motion in both directions. If one is working the bicep alone, generally there isn't a consistent resistance through the whole motion. Since there is going to be a resistance in the other direction as well, one will be inclined to work the complete range of motion without "cheating" and stopping short to relax, as there is no relaxation due to the fact that the opposing muscle group must start flexing right away. The end result is that both muscles which control the arm get a complete workout with the benefit of leading to strengthening throughout one's entire range of motion, in a simple and efficient manner.

In addition to the great benefits of the independently and infinitely variable resistance of the present invention, the mechanisms that provide the resistance allow for a 360-degree rotation. Muscle building equipment operates utilizing a linear mechanism by requiring the user to move against a resistance, generally against a weight, band, or spring. This mechanical motion is limited due to the fact that the weight, band, or spring can only move a certain linear distance, and must be returned to its original position in order for the exercise to be repeated. This may, depending on body size, limit the range of motion of the user. In addition, this type of resistance requires only one side of the opposing muscle groups to work as the weight or band is moved from, and returned to, its place of rest. The "Total Body Fitness Machine's" unique ability to rotate continually 360-degrees has no limitations in its range of motion because the resistance is not connected to a linear component such as a weight that must be returned to its original position to repeat an exercise. This allows the user to operate the machine not only as a muscle-building piece of equipment for the entire body, but also as a cardiovascular exercise piece of equipment simulating repetitive motions such as cycling, rowing, rotation of the arms in a circular motion (similarly to how the legs rotate in the cycling motion), and even running. In fact, any of the exercises on the machine can be set with a lower resistance in both directions so that all exercises can be done in high repetitions to build cardiovascular strength. Each 360-degree rotational resistance device operates independently, so as to offer a better workout. An example would be a comparison with a stationary bicycle. Generally, one is only focusing on the pushing of the pedals in a downward direction for each leg. This is due to the fact that the pedals are connected to the same crank. One really only works the quadriceps (thighs) because the hamstring relaxes as the other leg's quadriceps push down. This leads to the building of only one side of a leg's opposing muscle groups. Many muscle injuries, such as strains and pulls, in sports are actually the result of one's opposing muscle groups not being proportionally strengthened. On the "Total Body Fitness Machine" the exercise would actually require the person to apply a force throughout the entire range of motion for each leg separately, thus building both the muscle groups that straighten and bend the leg.

The machine is structured so that the seat and the resistance arms are adjustable in a variety of ways allowing a wide range of setup possibilities to target different muscle groups such as arms, legs, pectorals, and back to name a few. It is also possible to add a variety of attachments to the lever arms to increase the potential of exercise possibilities. This allows the implementation of the 360-degree rotational movement and the independently variable resistance to clockwise and counterclockwise motion toward the conditioning of all major muscle groups of the entire body. The "Total Body Fitness Machine" is the only unit which, using its unique 360-degree rotational movement and independently variable resistance to clockwise and counterclockwise motion, allows the user to workout virtually all of the muscles in the arms, torso, and legs with an almost limitless variety of exercises. These unique features allow a user to work with higher resistance—building muscle mass, medium resistance—building muscle tone, and lower resistance—building cardiovascular strength through continued repetitions over a sustained timeframe. Finally, we have one machine that effectively and efficiently joins the complete muscular workout with the complete cardiovascular workout. The components of the apparatus will be fully described in the following detailed description.

OBJECTS AND ADVANTAGES

Accordingly, several objects and advantages of my invention are:

a) that it is a simple machine with few necessary adjustments required to provide and almost unlimited quantity of muscular and cardiovascular exercises all within one machine;

b) that it offers two mechanisms which operate independently, and can be variably and separately adjusted to resist both clockwise and counter-clockwise motion with different forces allowing for a quick and efficient workout utilizing the body's natural design of opposing muscle groups to operate any joint in the body;

c) that its resistance mechanisms works on a rotational platform so complete 360-degree movement is possible—thus resulting in the potential of a variety of low resistance cardiovascular exercises such as a cycling motion to be performed; and d) that the machine's structure allows for the adjustments of the various parts which make it easily accessible for just about anyone to position themselves, or the resistance arms, to achieve a large variety of exercises—targeting a very specific muscle group or a variety of muscle groups.

DRAWINGS FIGURES

FIG. 1 is a perspective view of a complete body fitness machine of preferred embodiment in accordance with the present invention.

DETAILED DESCRIPTION OF THE PREFERRED EMBODIMENT

The various, non-resistance, parts of the apparatus shall be molded or tooled out of metal or plastic or other similar material that shall be comfortable to operate during exercise, provide for the necessary function it was designed for, as well as offer enough strength to withstand normal daily use. The resistance mechanism will be made of materials that could vary depending on whether the force is achieved electrically, magnetically, via friction such as a brake or belt, or by some other means of variable resistance, but will generally allow for the safe operation of the part within the complete machine.

With reference to the drawing FIG. 1, the complete body fitness machine according to the present invention mainly comprises a base 1, upright supports 2L (left) and 2R (right), a seat assembly 3, a support assembly for the seat 4, an assembly to secure the seat and it's support assembly to the frame 5, resistance generating mechanisms 6L (left) and 6R (right), lever arms 7L (left) and 7R (right), handles 8L (left) and 8R (right), and support assemblies for resistance generating mechanism, lever arms, and handles 9L (left) and 9R (right), and a mechanism for adjusting resistance of resistance mechanisms 10.

The frame is made up of a rectangular base 1, upright supports 2L (left) and 2R (right), and a support connected to either end of the rectangular frame 1 in the middle of the rectangular base 5. The seat support 4 is attached to the support in the middle of the frame 5. The seat assembly 3 is attached to the seat support 4.

The resistance mechanisms 6L (left) and 6R (right) are attached to the support assemblies 9L (left) and 9R (right). The lever arms 7L (left) and 7R (right) are attached to the resistance mechanisms 6L (left) and 6R (right). The handles 8L (left) and 8R (right) are attached to the lever arms 7L (left) and 7R (right). The support assemblies 9L (left) and 9R (right) are attached to the upright supports 2L (left) and 2R (right).

The mechanism that controls the resistance mechanisms 6L (left) and 6R (right) is attached to support upright 2L.

Operation

The frame, composed of 1, 2, and 5 is designed to provide a rigid support system for the machine's parts. The seat assembly 3 will support the person during exercise. The seat is secured to the frame support 5 through its support assembly 4. This will keep the seat assembly 3 and its support assembly in proper position during exercise. The seat can be locked into place at any point along the support 5, or allowed to move freely along the support 5, depending upon the desired setup for a particular exercise. Once in place on the seat, the support assemblies 9L (left) and 9R (right) shall be adjusted to the proper height on upright supports 2L (left) and 2R (right) so that the lever arms 7L and 7R and handles 8L and 8R will be at a comfortable and correct position for the desired exercise. The mechanism for controlling the resistance to clockwise and counterclockwise rotation shall be set independently. The unit, whether mechanical, or electrical, will determine the direction of rotation, and adjust the resistance according to the user's settings. The machine is now ready for exercise. The positions and settings may be varied throughout the workout for the performance of many different exercises.

CONCLUSIONS, RAMIFICATIONS, AND SCOPE

Thus the reader will see that the "Complete Body Fitness Machine" is the only machine that simply and effectively provides for the opportunity for someone to exercise opposing muscle groups within the same exercise, but having the ability to work against different forces for each of the opposing muscle groups within said given exercise. In addition, the "Complete Body Fitness Machine" is the only machine that combines the said variable resistance capabilities with the opportunity to have a continual 360-degree rotation of the resistance lever, allowing for cardiovascular exercise as well as muscle building exercise. This is truly a complete body fitness machine offering an almost limitless variety of muscle building and cardiovascular system building potential all within one simple and easy to use machine.

While my above description contains many specificities, these should not be construed as limitations on the scope of the invention, but rather as an exemplification of one preferred embodiment thereof. Many other variations are possible. For example, the resistance mechanisms may be electrical, fluid, friction, or some other means of creating a resistance to movement in design, or the means for controlling these resistance mechanisms may be digital, analog, or mechanical, and end result will be the same.

Accordingly, the scope of the invention should be determined not by the embodiment(s) illustrated, but by the appended claims and their legal equivalents.

I claim:

1. A body fitness machine comprising;

a frame;

a first resistance mechanism attached to said frame;

a setting means for setting the resistance of said resistance mechanism, said setting means permitting a user to set a first resistance and at least a second resistance concurrently; and a first lever arm operationally connected to said first resistance mechanism which provides a means with which to rotate said first resistance mechanism against said first and second resistances, wherein said first lever arm can rotate in a first direction and in a second direction and said first resistance is applied when said first lever arm is moving in said first direction and said second resistance is applied when said second lever arm is moving is said second direction.

2. The body fitness machine recited in claim 1, said body fitness machine further comprising:

a second resistance mechanism attached to said frame;

a second lever arm operationally connected to said second resistance mechanism.

3. The body fitness machine recited in claim 2 wherein said setting means permits the user to set a third resistance and a fourth resistance for said second resistance mechanism.

4. The body fitness machine recited in claim 3 wherein said setting means permits the user to set said third and fourth resistances concurrently with setting said first and second resistances.

5. The body fitness machine recited in claim 4 wherein said first and second resistances can be set to be different from said third and fourth resistances.

6. The body fitness machine recited in claim 1 wherein said first lever arm can be continually rotated 360 degrees while in use.

* * * * *